US012643641B1

(12) United States Patent
Wilkinson

(10) Patent No.: US 12,643,641 B1
(45) Date of Patent: Jun. 2, 2026

(54) METHOD OF WAKE SURFING UTILIZING A WAKE BOARDING PROPULSION SYSTEM

(71) Applicant: Kerry Wilkinson, Tempe, AZ (US)

(72) Inventor: Kerry Wilkinson, Tempe, AZ (US)

( * ) Notice: Subject to any disclaimer, the term of this patent is extended or adjusted under 35 U.S.C. 154(b) by 724 days.

(21) Appl. No.: 17/581,016

(22) Filed: Jan. 21, 2022

Related U.S. Application Data

(60) Provisional application No. 63/140,221, filed on Jan. 21, 2021.

(51) Int. Cl.

| | |
|---|---|
| ***B63B 34/70*** | (2020.01) |
| ***B63B 34/75*** | (2020.01) |
| ***B63B 39/06*** | (2006.01) |
| ***B63H 11/107*** | (2006.01) |
| ***B63H 11/117*** | (2006.01) |

(52) U.S. Cl.
CPC ..... *B63B 34/70* (2020.02); *B63B 34/75* (2020.02); *B63B 39/061* (2013.01); *B63H 11/107* (2013.01); *B63H 11/117* (2013.01)

(58) Field of Classification Search
CPC ... B63B 34/70; B63B 34/75; B63B 2001/281; B63B 1/30; B63B 1/32; B63B 2001/325; B63B 39/06; B63B 39/061; B63B 2039/065; B63H 5/08; B63H 5/125; B63H 11/10; B63H 11/101; B63H 11/107; B63H 11/113; B63H 11/117; B63H 25/44; B63H 25/48
See application file for complete search history.

(56) References Cited

U.S. PATENT DOCUMENTS

| | | | | |
|---|---|---|---|---|
| 4,815,996 | A * | 3/1989 | Carr | B63H 5/125 440/83 |
| 5,203,728 | A * | 4/1993 | Kobayashi | B63B 17/0018 440/38 |
| 7,131,385 | B1 | 11/2006 | Ehlers et al. | |
| 9,238,499 | B1 | 1/2016 | Viviani et al. | |
| 9,796,451 | B2 | 10/2017 | Brendel | |
| 9,855,995 | B2 | 1/2018 | Fafard et al. | |
| 10,167,057 | B1 * | 1/2019 | Terada | B63B 1/32 |
| 10,179,532 | B2 | 1/2019 | Taylor | |
| 10,683,061 | B2 | 6/2020 | Gasper et al. | |

(Continued)

FOREIGN PATENT DOCUMENTS

WO WO-2024173008 A1 * 8/2024

*Primary Examiner* — Ajay Vasudeva
(74) *Attorney, Agent, or Firm* — Invention To Patent Services; Alex Hobson

(57) ABSTRACT

A method of wake surfing utilizes a marine vessel having a first propulsion device and a second propulsion device that produce thrust having thrust axes that are offset from one another or not parallel. A first propulsion device may have a thrust axis that is controlled to a first thrust offset angle with respect to the second thrust axis. This offset angle may direct a flow of water from the first propulsion device into a flow of water produced from the second propulsion device and thereby produce an effective wake surfing wake. The first thrust axis may be along a horizontal and/or vertical plane with respect to second thrust axis. One or more deflectors may be coupled with the boat to aid in formation of the wake surfing wake. A controller may control the thrust axis and/or the amount of thrust produced by the propulsion devices, independently.

4 Claims, 6 Drawing Sheets

(56) References Cited

U.S. PATENT DOCUMENTS

| | | | | |
|---|---|---|---|---|
| 11,352,117 | B1 * | 6/2022 | Blew | B63H 21/17 |
| 12,049,287 | B1 * | 7/2024 | Donnelly | B63B 34/70 |
| 2015/0158568 | A1 | 6/2015 | Markus et al. | |
| 2019/0144087 | A1 * | 5/2019 | Cole | B63B 1/32 114/271 |
| 2019/0210694 | A1 | 7/2019 | Ryan et al. | |
| 2019/0217921 | A1 | 7/2019 | Shibayama et al. | |
| 2019/0291830 | A1 | 9/2019 | Joakim et al. | |
| 2020/0262523 | A1 | 8/2020 | Decker | |

* cited by examiner

METHOD OF WAKE SURFING UTILIZING A WAKE BOARDING PROPULSION SYSTEM

CROSS REFERENCE TO RELATED APPLICATIONS

This application claims the benefit of priority to U.S. provisional application No. 63/140,221, filed on Jan. 21, 2021, the entirety of which is hereby incorporated by reference herein.

BACKGROUND OF THE INVENTION

Field of the Invention

The invention relates to a method of wake surfing utilizing a marine vessel having a first propulsion device and a second propulsion device that produce thrust having thrust axes that are not parallel.

Background

Wake surfing has become a very popular activity but requires the boat to be modified to create a wake behind the boat. In some cases, the stern of the boat is weighted to cause the stern to sink deeper in the water. In other cases, one or more deflectors are coupled to the boat to direct a flow of water to produce or increase a wake. These adaptations to the boat are sometimes permanent thereby changing the handling, performance and operation of the boat. The modifications may be temporary but require some time to set up and remove each time the boat is to be used for wake surfing. Some boats adapted for wake surfing have a limited speed, thereby requiring more time and fuel to travel to a desired location, such as a cove for wake surfing, from the dock.

SUMMARY OF THE INVENTION

The invention is directed to a method of wake surfing utilizing a marine vessel having a first propulsion device and a second propulsion device that each produce thrust having a thrust axis, wherein the two thrust axes are not parallel, wherein the first thrust axis is offset an offset angle of at least 10 degrees from said second thrust axis. A first propulsion device may have a thrust axis angle that is controlled to an offset angle with respect to the second thrust axis. The two propulsion devices may be configured to produce a thrust that is substantially parallel with the length axis of the marine vessel, or the direction of travel of the marine vessel when traveling, such as from the dock to a desired wake boarding location. However, one or both of the propulsion devices may then be controlled to direct a thrust along a thrust axis that is at an offset angle, wherein the two thrust axes are not parallel. One or both of the propulsion devices may produce a thrust that is offset with respect to the centerline or length axis of the marine vessel or direction of travel of the marine vessel, along a horizontal plane and/or vertical plane. This offset angle orientation of the thrust axis or thrust axes may direct a flow of water from the first propulsion device into the flow of water produced from the second propulsion device and thereby produce an effective wake for wake surfing. One or both of the propulsion devices may be controlled to produce a thrust having a thrust axis that is at an offset angle. The offset angle of the first thrust axis of the first propulsion device may be along a horizontal plane and/or along a vertical plane, with respect to a second thrust axis of the second propulsion device. In an exemplary embodiment, the first thrust axis intersects with the second thrust axis along a horizontal plane, thereby causing the flow of water produced from the first propulsion device to intersect with the flow of water produced by the second propulsion device to produce an effective wake wave for wake surfing. In another example, the first propulsion device produces a thrust with a first thrust axis that is offset along the vertical plane from the second thrust axis of the second propulsion device, and this offset angle produces a flow of water that is more downward than the flow of water from the second propulsion device; thereby producing an effective wake surfing wake having a wake wave. A combination of horizontal plane and vertical plane thrust axes angle offsets may be desirable to produce an effective and consistent wake surfing wake.

The first and second propulsion devices produce an amount of thrust and a thrust power controller may control the amount of thrust produced. Each of the first and second propulsion devices may have separate thrust power controllers to enable them to be controlled independently. The combination of an offset thrust axis and differential amounts of thrust may be utilized to produce an effective wake wave. For example, a first propulsion device may be offset an offset thrust angle to produce a first thrust axis that is offset with respect to the length axis a greater amount than an second thrust axis offset of the second propulsion device, but may produce less thrust, thereby creating an effective wake wave with the marine vessel having a direction of travel that is substantially along the centerline of the marine vessel, such as within 10 degrees of the centerline, and preferably within 5 degrees of the centerline axis.

An exemplary marine vessel is a recreational marine vessel having a length of no more than about 15 m (about 50 ft), wherein most are less than about 11 m (about 35 ft), with most wake boarding vessels being between about 4.25 m (about 14 ft) or more to about 9 m (about 30 ft) or less. An exemplary marine vessel has V-hull shape.

An exemplary propulsion device is a motor having a propeller. The propulsion device and propeller are configured at least partially below a water level to produce a thrust and a water flow that is directed in a thrust axis. One or both of the propulsion devices may have a shroud to further direct the thrust and flow of water therefrom. The shrouds may be aligned with the thrust axis or may be configured to rotate or pivot to produce a thrust having an offset thrust axis, offset with respect to a second propulsion device. While a propeller may be the most conventional form of propulsion device for a watercraft, jet drive systems, utilizing a water jet, or pump drive systems may also be utilized.

In an exemplary embodiment, the first propulsion device is configured on a first side of the marine vessel and the second propulsion device is configured on a second side of the marine vessel, with respect to a centerline of the marine vessel. In an exemplary embodiment, the first propulsion device is configured above the second propulsion device along a horizontal plane with respect to the marine vessel.

The thrust axis of the first propulsion device is controlled by a first thrust axis controller that is coupled with the thrust vector controller to change the first thrust axis. The second propulsion device may be fixed and may not be coupled with a controller to change the thrust axis. However, in an exemplary embodiment, both the first and second propulsion devices have a thrust axis controller, wherein the two propulsion devices can be controlled to have a thrust axis that is directed toward the other, causing the two thrusts to be forced into each other. A thrust axis controller may be configured to change the thrust axis along a horizontal plane and/or along a vertical plane. A first thrust axis controller may have a first propulsion power controller and the second thrust axis controller may have a second propulsion power controller to change the respective magnitude of thrust. The two propulsion devices may have a single propulsion power controller however.

The controller embodiments for changing the thrust axis of the first and/or second propulsion devices may be configured to change the orientation of a shroud and thereby change the thrust axis by directing at least a portion of the thrust through the shroud.

An exemplary wake surfing method may employ one or more wave-shaping deflectors that are coupled to the marine vessel to direct water to aid in forming an effective wake surfing wake. The wave-shaping deflector may be configured on and/or extend from a hull of the marine vessel, from the port and/or starboard sides, and/or from the stern. A wave-shaping deflector may be configured on one side or on both sides of the marine vessel or on either side of the two propulsion devices. A wave-shaping deflector may be a vertical wave-shaping deflector that deflects water in vertical direction, to produce a transverse force on the marine vessel with respect to the centerline of the marine vessel. A wave-shaping deflector may be a horizontal wave-shaping deflector that deflects water in vertical direction to produce an upward or downward force on the marine vessel, similar to a trim tab to help with planning of a marine vessel. Also, a wave-shaping deflector may be a combination of a vertical and horizonal wave-deflector wherein it is positioned to produce both a vertical and transverse force on the marine vessel. A wave-shaping deflector may be configured to produce a transverse force on the marine vessel with respect to the centerline of the marine vessel, such that it would turn the marine vessel and the propulsion device may be controlled to an offset axis to counter this force such that the marine vessel has a direction of travel that is substantially along the centerline of the marine vessel, as defined herein.

A combination of forces from a wave-shaping deflector or deflectors and/or a propulsion device may cause the marine vessel to travel through the water in a direction that is offset from the centerline of the marine vessel. This offset direction of travel may produce a more effective wake wave.

The method of wake surfing may use any suitable wake surfing implement, including, but not limited to, a wake board, a surf board, a water ski, a knee board or bogie board, or a tube, such an inflatable tube. Wake surfing may be performed by holding onto a tether coupled to the marine craft, or without any tether.

Definitions

Wake surfing is defined as any watersport performed on a wake produced by a boat and includes, but is not limited to, wake boarding, water skiing, knee-boarding, tethered wake surfing, tethered tubing and the like.

Effectively non-parallel, with respect to the thrust axis of the first and second propulsion devices means that the thrust axis of one or both of the propulsion devices is adjusted along the horizontal plane and/or vertical plane to produce a wake wave in the wake, and may include offset thrust angles of about 10 degrees or more, or about 15 degrees or more, about 20 degrees or more, about 30 degrees or more and any range between and including the offset thrust angles provided. The offset thrust angle maybe offset with respect to the length axis of the marine vessel, a line that is parallel with the length from the bow to the stern.

A wake surfing wake is a wave in the wake of the marine vessel that is at least 0.5 meters high, and preferably 0.75 m high and even more 1 m high or more, and may be a smooth curved wave in the wake.

Substantially greater thrust of a first propulsion device to a second propulsion device, as used herein, means at least a 10% greater, at least a 15% greater, at least a 25% greater and may be much more, such as double or more. The difference in thrust combined with offset thrust axis may produce an effective wake wave while moving the marine vessel in a direction of travel that is along the centerline of the marine vessel or not aligned with the centerline of the marine vessel.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
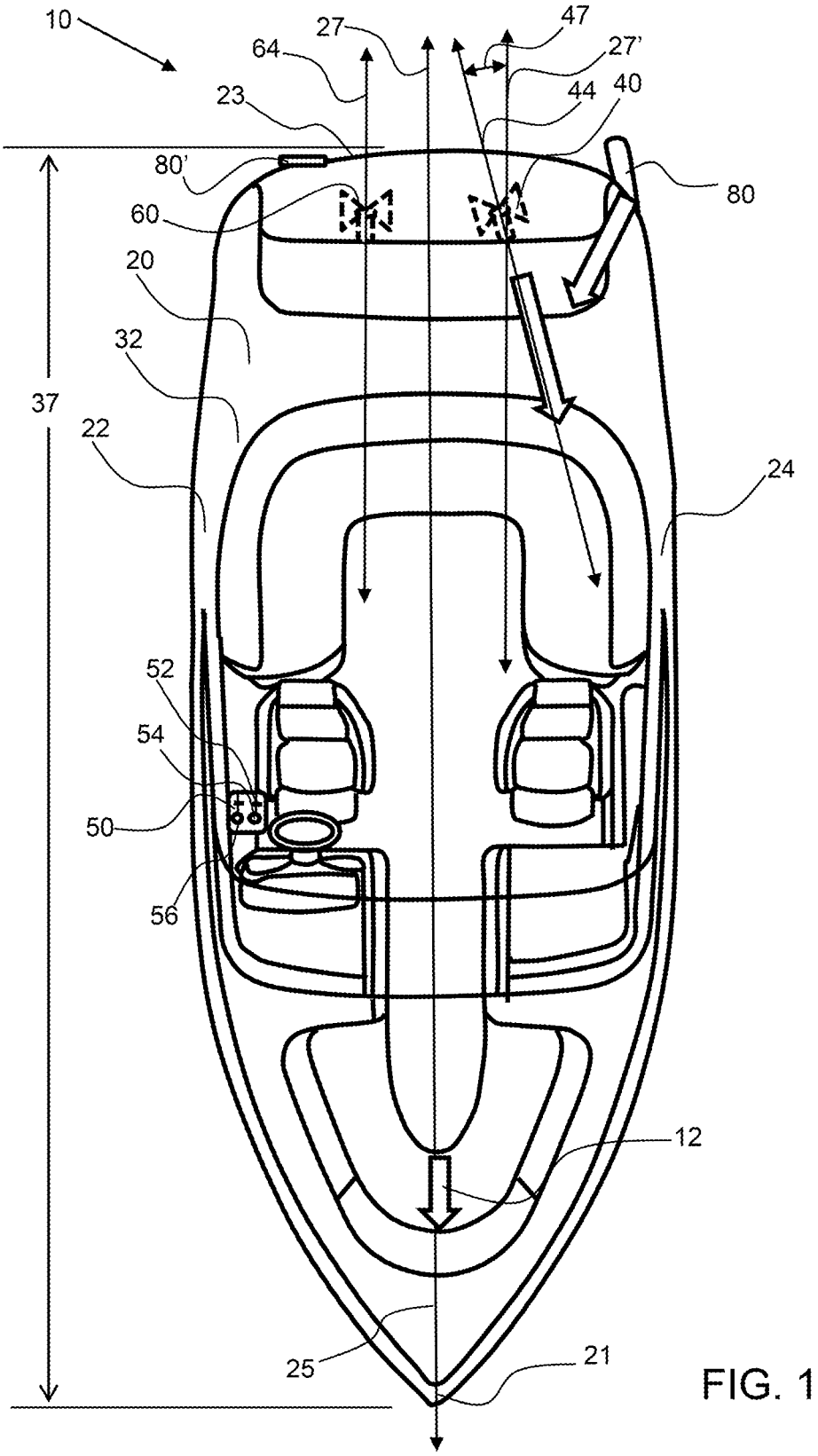
FIG. 1 shows a top view of an exemplary recreational marine vessel having a wake boarding propulsion system employing a first propulsion device configured at a thrust axis that is offset along a horizontal plane to a thrust axis of a second propulsion device.

Corresponding reference characters indicate corresponding parts throughout the several views of the figures. Note that not all features of the invention are shown in each and every figure for the ease of illustration. It is to be understood however that the features may be combined where they are not exclusive features. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including." "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary recreational marine vessel 32 has a wake boarding propulsion system 10 employing a first propulsion device 40 configured at a first thrust axis 44 that is offset from the length axis 27 of the marine vessel 20, and a second propulsion device 60 that has a second thrust axis 64 that is substantially parallel with the length axis. The first thrust axis is offset an offset horizontal plane angle 47 from the thrust axis 64 of the second propulsion device or with respect to the length axis 27 of the marine vessel 20. A secondar length axis line 27' is shown parallel with the length axis and extending through the first propulsion device 40. The offset first thrust axis modifies the wake to produce a wake wave for wake surfing. A thrust controller 50 has a first thrust axis controller 54 that enables adjustment of the first thrust axis along the vertical plane or horizontal plane and a second thrust axis controller 56 that enables adjustment of the second thrust axis along the vertical plane or horizontal plane. Each of the first and second thrust axis controllers may also have a thrust power controller 52, wherein the amount of thrust from the two propulsion devices can be controlled independently. The first propulsion device is configured on a port side 24 and the second propulsion device is configured on the starboard side 22, with respect to the centerline 25. Note that the first thrust axis 44 may produce a force, as indicated by the bold arrow along the first thrust axis 44, on the marine vessel to create a force vector that is not aligned with the centerline 25 or hull axis of the marine vessel, and the wave-shaping deflector 80 may be configured to counter this force, as indicated by the large arrow extending from the wave-shaping deflector, such that the marine vessel has a direction of travel 12 that is substantially along the centerline of the marine vessel, while producing an effective wake wave. The wave-shaping deflector and the first propulsion device work in tandem to produce a wake wave while producing counter balancing forces on the marine vessel. It may be desirable to move the marine vessel in a direction of travel 12 that is not aligned with the centerline 25 axis of the marine vessel to produce a more effective wake wave. A second wave-shaping deflector 80' may be a horizontal wave shaping deflector that produces an upward or downward force on the marine vessel.

The recreational marine vessel 32 has a length 37 from the bow 21 to the stern 23 that may be no more than about 15.24 m, (50 ft), no more than about 12.2 m, (40 ft), no more than about 9.12, (30 ft) and any range between and including the lengths provided. Put another way, the recreational marine vessel may be of a size to accommodate about 15 passengers or less, about 10 passengers or less, about 8 passengers or less and any range between and including the number of passengers listed.

Figure 2:
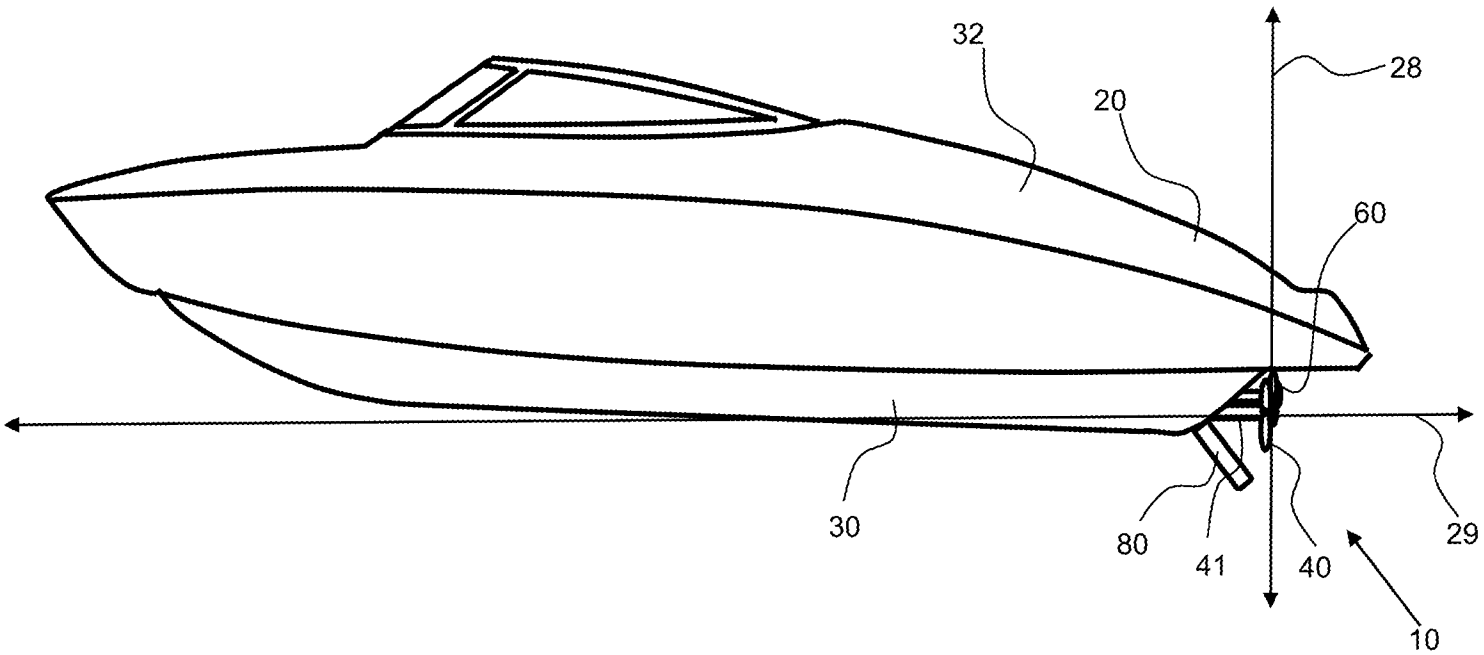
FIG. 2 shows a side view of an exemplary recreational marine vessel having a wake boarding propulsion system employing two propulsion devices.

As shown in FIG. 2, an exemplary recreational marine vessel has a wake boarding propulsion system 10 employing a first propulsion device 40 and a second propulsion device 60. The first propulsion device and/or the second propulsion device may be configured at an offset thrust axis that is offset along the horizontal plane 29 and/or the vertical plane 28. The first and second propulsion devices may have separate drive shafts 41 to propel the propellers independently or they may be coupled to single drive shaft or coupled to a single drive shaft, such as by gears. Also shown in FIG. 2 is a wave-shaping deflector 80 extending back from the stern 23 of the marine vessel. The deflector may deflect water as it flows past the deflector to enhance wake wave production. The deflector and the offset axis propulsion devices may work in concert to produce an effective wave wake in the wake. A deflector may be configured to produce a transverse force on the marine vessel such that it would turn the marine vessel and the propulsion device may be controlled to an offset axis to counter this force such that the marine vessel marine vessel has a direction of travel that is substantially along the centerline of the marine vessel, as defined herein.

Figure 3:
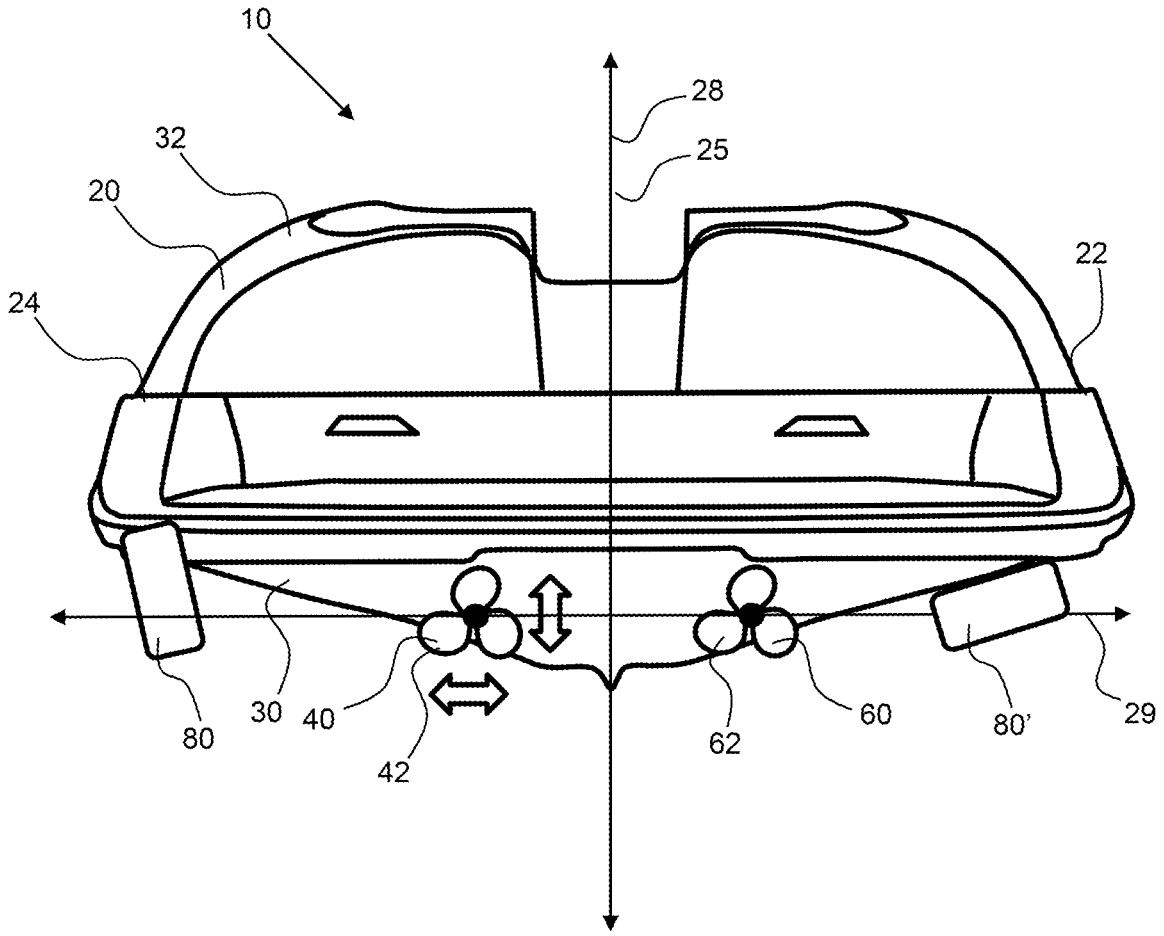
FIG. 3 shows a stern or back view of an exemplary recreational marine vessel having a wake boarding propulsion system employing a first propulsion device and a second propulsion device.

As shown in FIG. 3, an exemplary recreational marine vessel 32 has a wake boarding propulsion system 10 employing a first propulsion device 40 and a second propulsion device 60. The first propulsion device is configured on a port side 24 and the second propulsion device is configured on the starboard side 22, with respect to the centerline 25. The first and/or second propulsion device may be adjusted along the horizonal plane 29 and/or the vertical plane 28. When the thrust axis of a propulsion device is adjusted along the horizontal plane, the thrust produced is at an offset angle along the horizontal plane and when the thrust axis of a propulsion device is adjusted along the vertical plane, the thrust produced is at an offset angle along the vertical plane. Note that the thrust axis may be adjusted along both the horizontal and vertical planes to produce a desired wake wave. A first wave-shaping deflector 80 is configured on the port side 24 of the marine vessel 20 and may be configured to deflect water in a vertical direction. A second wave-shaping deflector 80' is configured to deflect water in a horizontal direction. As described herein, a combination of wave-shaping deflector(s) and propulsion devices with one or both configured at offset thrust axes may produce an effective wake wave for wake surfing. The hull 30 of the exemplary recreational marine vessel 32 is a V-hull but may also be a modified V-hull with recesses in the hull between the centerline and sides. The first propulsion device utilizes a propeller 42 and the second propulsion device also has a propeller 60.

Figure 4:
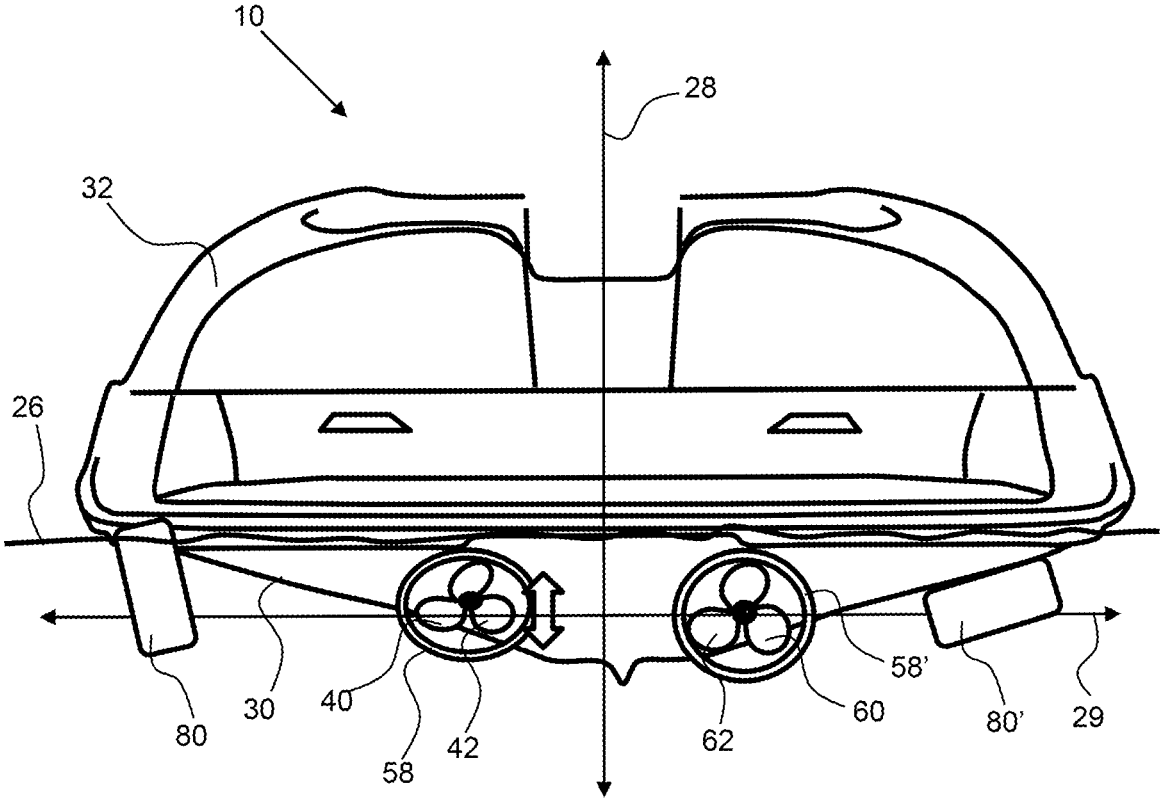
FIG. 4 shows a stern or back view of an exemplary recreational marine vessel having a wake boarding propulsion system employing a first propulsion device and a second propulsion device, each having a shroud.
Figure 5:
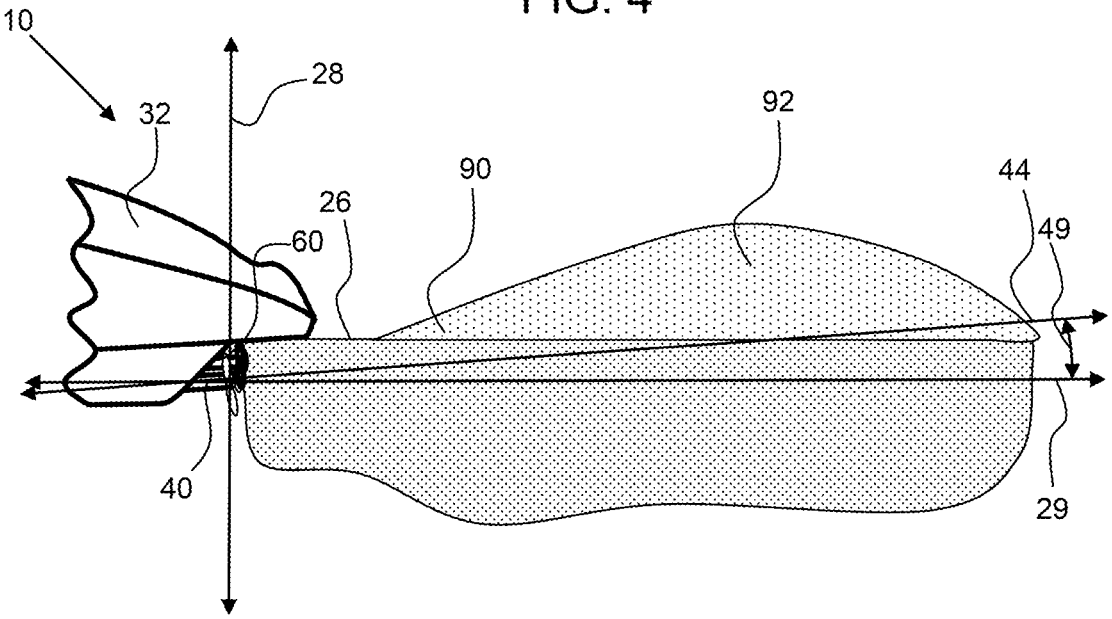
FIG. 5 shows a side view of a portion of an exemplary recreational marine vessel having a wake boarding propulsion system and a wake surfing wake having a wake wave.

Referring now to FIGS. 4 and 5, an exemplary recreational marine vessel 32 has a wake boarding propulsion system 10 employing a first propulsion device 40 configured at an offset vertical plane angle 49 and a second propulsion device 60. The first thrust axis 44 is offset along the vertical plane 28 to produce a wake wave 92 in the wake 90. As shown in FIG. 4, both the first and second propulsion devices are below the waterline 26 and both have shrouds 58, 58' around the propellers 42, 62, respectively. The shrouds, which are a portion of the propulsion device may be configured to direct the thrust along a thrust axis. The shrouds may be controlled by the thrust axis controllers as described herein.

Figure 6:
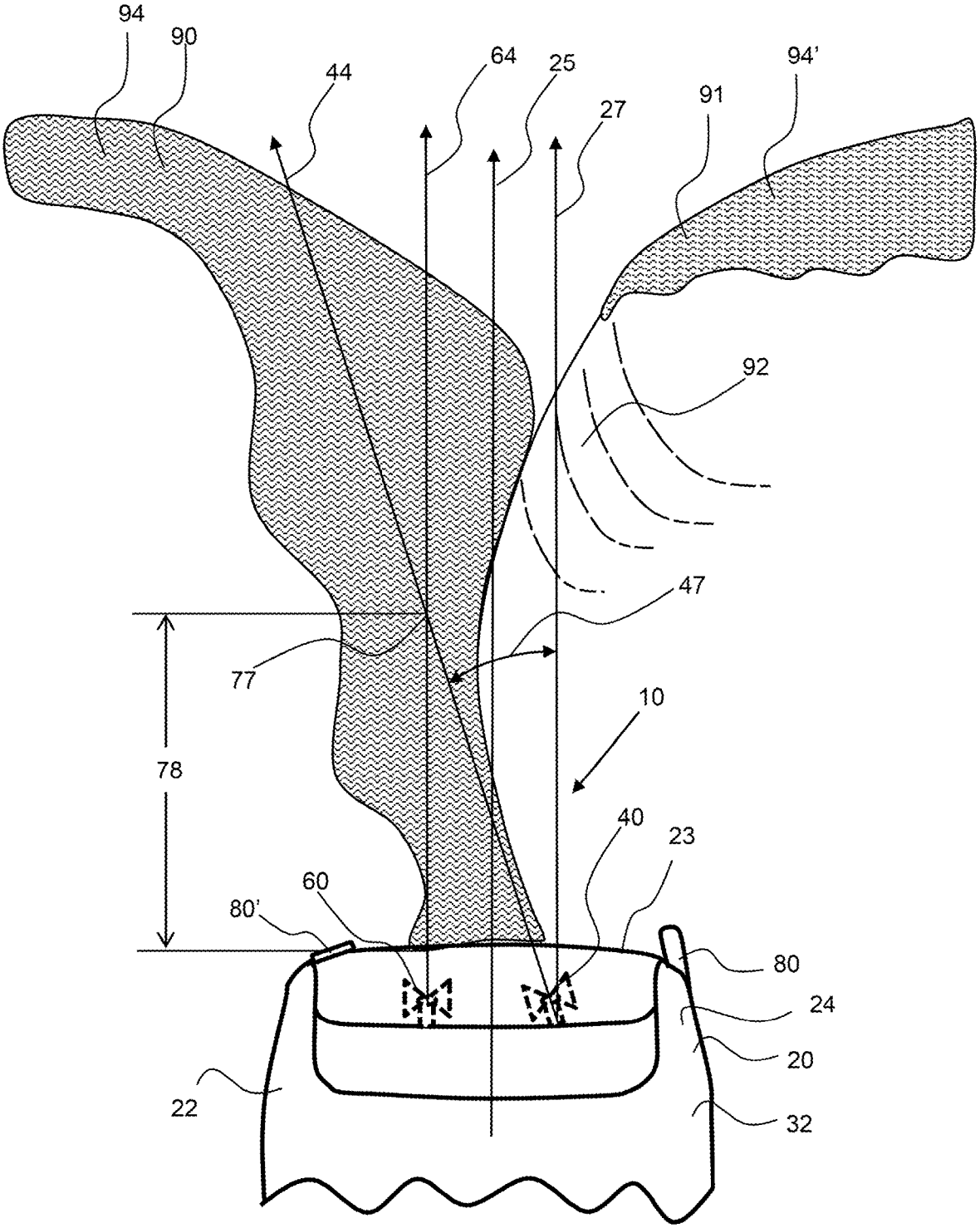
FIG. 6 shows a top view of a portion of an exemplary recreational marine vessel having a wake boarding propulsion system employing a first propulsion device producing a first thrust at a thrust axis that is offset along a horizontal plane angle to the thrust axis of a second propulsion device and the wake having a wake wave formed therefrom.

As shown in FIG. 6, an exemplary recreational marine vessel 32 has a wake boarding propulsion system 10 employing a first propulsion device 40 having a first thrust axis 44 configured at an offset horizontal plane angle 47 with respect to a length axis 27 of the marine vessel 20. The thrust from the first propulsion device, extending along the first thrust axis 44, intercepts the thrust of the second propulsion device, extending along the second thrust axis 64, at a thrust axis intercept 77 configured at a thrust axis intercept offset distance 78 from the stern 23 of the marine vessel. This offset thrust axis of the first propulsion device aids in forming the wake wave 92 in the wake surfing wake 91. Notice that the wake 90 is non-uniform, wherein the wake chop 94 on the starboard side 22 is much greater than on the stern side 23, wherein the wake chop 94' is produced flowing the break in the wake wave 92. The second propulsion device produces thrust having a second thrust axis 64 that is substantially aligned with the length axis 27 or centerline 25 of the marine vessel.

Figure 7:
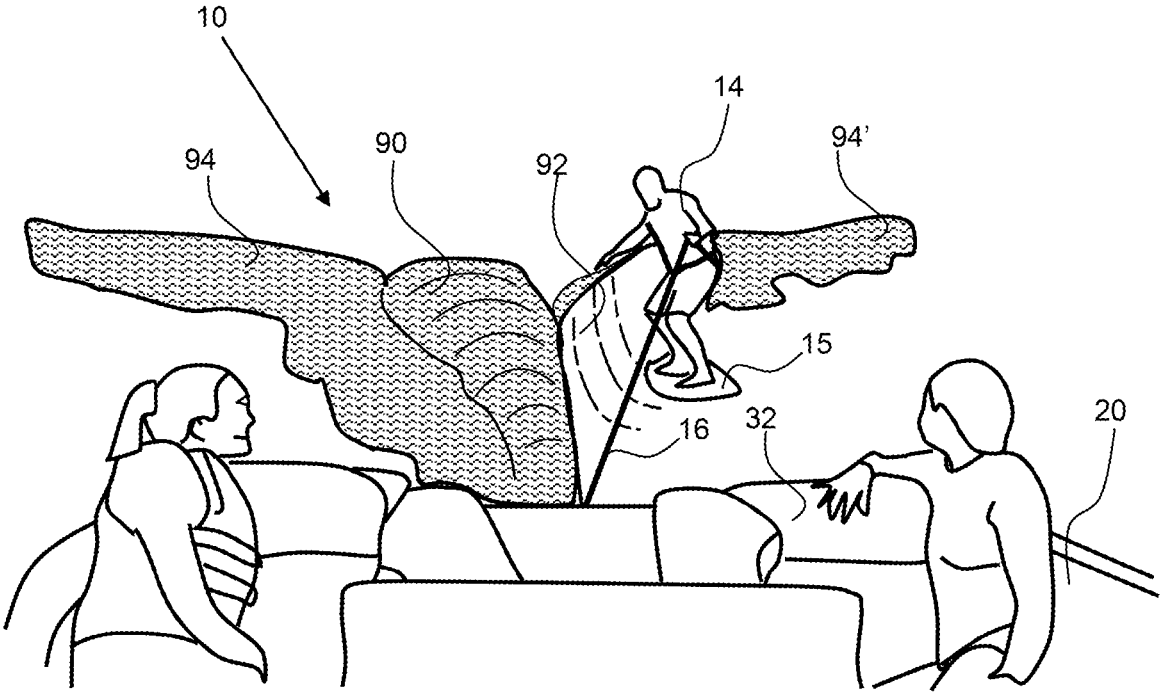
FIG. 7 shows a perspective view of an exemplary recreational marine vessel having a wake boarding propulsion system employing a first propulsion device configured at an offset thrust angle and the wake having a wake wave formed therefrom for a wake surfer to surf.

As shown in FIG. 7, an exemplary recreational marine vessel 32 has a wake boarding propulsion system 10 employing a first propulsion device configured at an offset thrust angle to produce a wake wave 92 in a wake surfing wake 91. As shown, the wake wave has a curl portion wherein the wake surfer 14 surfs by holding onto the wake tether 16. Note that wake surfing can be performed without the tether. The exemplary wake surfing implement 15 is a wake board.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of wake surfing comprising:

a) providing a marine vessel in water, wherein the marine vessel comprises:

i) a first propulsion device coupled to the marine vessel on a first side of a longitudinal centerline of the marine vessel and comprising a first propeller with a first shroud, the first propulsion device configured to produce a first thrust having a first thrust axis;

ii) a first thrust axis controller and a first thrust power controller, wherein the first thrust axis controller controls the orientation of the first shroud to adjust the first thrust axis of the first propulsion device;

iii) a second propulsion device coupled to the marine vessel on a second side of the longitudinal centerline of the marine vessel and comprising a second propeller with a second shroud, the second propulsion device configured to produce a second thrust having a second thrust axis;

iv) a second thrust axis controller and a second thrust power controller, wherein the second thrust axis controller controls the orientation of the second shroud to adjust the second thrust axis of the second propulsion device; and v) a first wave-shaping deflector on the first side of the marine vessel, wherein the first wave-shaping deflector is a vertical wave-shaping deflector attached proximate a lateral edge of the marine vessel and extending below a waterline to create a transverse force on the marine vessel;

b) adjusting the first thrust axis controller to change the direction of the first thrust axis of the first propulsion device along horizontal and vertical planes, wherein the first thrust axis is turned by at least 10 degrees toward the second thrust axis while maintaining the second thrust axis substantially parallel to the longitudinal centerline of the marine vessel, and wherein the first thrust axis is substantially vertically offset from the second thrust axis, thereby producing a surfing wake wave;

c) adjusting the first wave-shaping deflector to produce a transverse force on the marine vessel for countering unbalanced propulsion forces on the vessel and maintaining the vessel propulsion direction substantially along the centerline of the vessel;

d) providing a wake board for surfing on the wake wave;

wherein the marine vessel is a recreational marine vessel having a length of no more than 50 ft; and wherein the marine vessel has a V-hull shape.

2. The method of wake surfing of claim 1, wherein the first thrust power controller adjusts a first thrust power generated by the first propulsion device and the second thrust power controller adjusts a second thrust power generated by the second propulsion device, wherein the first thrust power is substantially different relative to the second thrust power.

3. The method of wake surfing of claim 2, wherein the first thrust power is at least 10% greater than the second thrust power.

4. The method of wake surfing of claim 1, wherein a second wave-shaping deflector is coupled to the marine vessel, wherein the second deflector is a horizontal wave-shaping deflector configured to create an upward or downward force on the marine vessel.

* * * * *